US006879238B2

(12) United States Patent
Liu et al.

(10) Patent No.: US 6,879,238 B2
(45) Date of Patent: Apr. 12, 2005

(54) CONFIGURATION AND METHOD FOR MANUFACTURING COMPACT HIGH CURRENT INDUCTOR COIL

(75) Inventors: Chun-Tiao Liu, Hsinchu (TW); Yi-Min Huang, Hsinchu (TW)

(73) Assignee: Cyntec Company, Hsinchu (TW)

( * ) Notice: Subject to any disclaimer, the term of this patent is extended or adjusted under 35 U.S.C. 154(b) by 128 days.

(21) Appl. No.: 10/447,760

(22) Filed: May 28, 2003

(65) Prior Publication Data

US 2004/0239467 A1 Dec. 2, 2004

(51) Int. Cl.[7] ..... H01F 27/28

(52) U.S. Cl. ..... 336/232; 336/96

(58) Field of Search ..... 336/90, 96, 192, 336/200, 205, 232

(56) References Cited

U.S. PATENT DOCUMENTS 4,223,360 A * 9/1980 Sansom et al. ..... 360/123
6,317,965 B1 * 11/2001 Okamoto et al. ..... 29/602.1
6,438,000 B1 * 8/2002 Okamoto et al. ..... 363/40
6,774,757 B2 * 8/2004 Fujiyoshi et al. ..... 336/200

* cited by examiner

*Primary Examiner*—Ramon M. Barrera
(74) *Attorney, Agent, or Firm*—Bo-In Lin

(57) ABSTRACT

This invention discloses a method for manufacturing an inductor by first press punching a first and a second layer of conductive plates into a first and second coil layers with a first and second inductor lead layers as single integrated layers. The manufacturing process further includes a step of overlapping and connecting the first and second coil layers to form an inductor. In a preferred embodiment, process of manufacturing further includes a step of mixing epoxy to bond with a highly magnetic material and pressure molding the bonding magnetic material around the coil layers to form an inductor.

20 Claims, 7 Drawing Sheets

Fig.1A
(Prior Art)
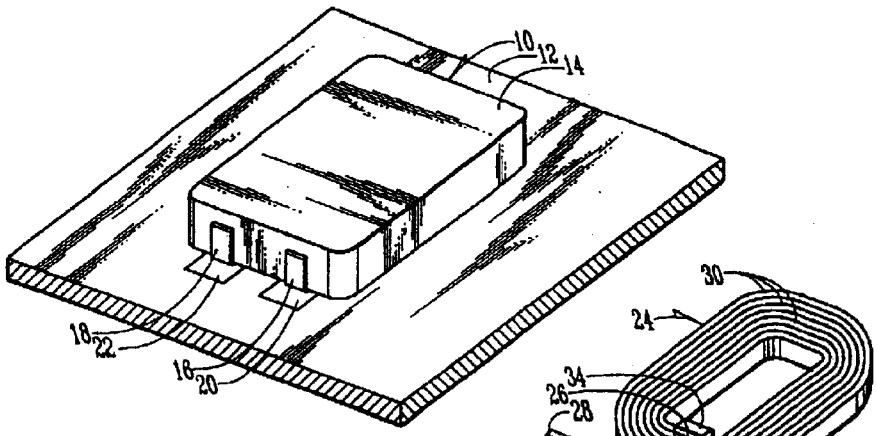
Fig.1B
(Prior Art)
Fig.1C
(Prior Art)
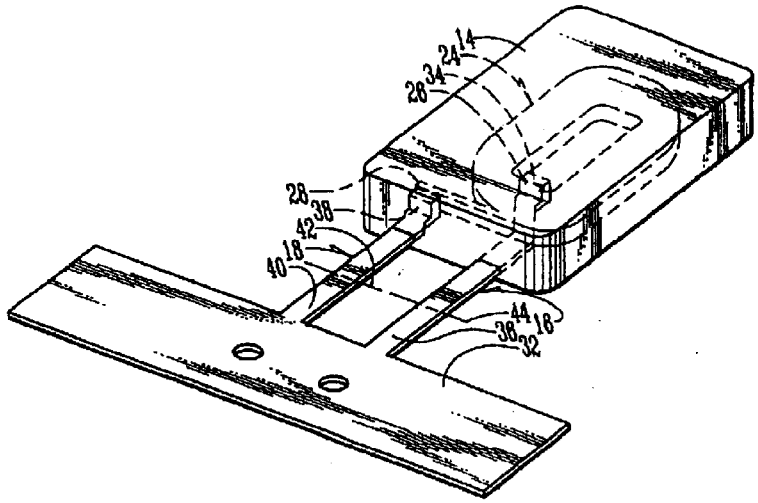

CONFIGURATION AND METHOD FOR MANUFACTURING COMPACT HIGH CURRENT INDUCTOR COIL

BACKGROUND OF THE INVENTION

1. Field of the Invention

This invention relates generally to the device configuration and processes for manufacturing inductor coils. More particularly, this invention relates to an improved configuration and process for manufacturing compact and high current inductor coils.

2. Description of the Prior Art

For those of ordinary skill in the art, the configurations and the process of manufacturing a high current inductor coil are still faced with technical challenges that inductor coils manufactured with current technology still does not provide sufficient compact form factor often required by application in modern electronic devices. Furthermore, conventional inductor coils are is still manufactured with complicate manufacturing processes that involve multiple steps of epoxy bonding and wire welding processes.

Shafer et al. disclose a high current low profile inductor in a U.S. Pat. No. 6,204,744, as that shown in FIG. 1. The inductor disclosed by Shafer et al. includes a wire coil having an inter coil end and an outer coil end. A magnetic material completely surrounds the wire coil to form an inductor body. First and second leads connected to the inner coil end and the outer coil end respectively extend through the magnetic material to the exterior of the inductor body. As shown in FIG. 1, the inductor coil 10 is mounted on a circuit board 12. The inductor coil 10 includes an inductor body 14 that has a first lead 16 and a second lead 18 extending outwardly from the coil 10. The leads 16 and 18 are bent and folded under the bottom of the inductor body 14 and are shown soldered to a first pad and a second pad 20, 22 respectively. As shown in FIG. 1B, the inductor 10 is constructed by forming a wire coil 24 from a flat wire having a rectangular cross section. By forming the wire into a helical coil. The coil 24 includes a plurality of turns 30 and also includes an inner end 26 and an outer end 28. A lead frame 32 that includes a first lead 16, which has one end 34, welded to the inner end 26 of the coil 24. The lead frame also includes a second lead 18 which has one end 38 welded to the outer end 28 of coil 24. The leads 16 and 18 include free ends 36, 40, which are attached to the lead, frame 32. A resist welding process is applied to weld of ends 34, 38 to the inner end 26 and the outer end 28 of coil 24.

The inductor coil as shown in FIGS. 1A and 1B by Shafer et al. still have several limitations. As the wire coil 24 formed by flat wires that has stand on a vertical direction, the height of the flat wire 24 becomes an inherent limitation to the form factor of the inductor coil. Further miniaturization of the inductor coil becomes much more difficult with a vertical standing flat wire as shown in FIG. 1B. The production cost is also increased due to the requirements that the lead frame and the coil must be separately manufactured. The manufacture processes are further complicated as several welding and bonding steps are required to securely attach the welding ends of the flat wire to the welding points of the lead frame. The production yields and time required to manufacture the inductor coil are adversely affected due to the more complicate inductor configurations and multiple boding and welding manufacturing processes.

Therefore, a need still exists in the art of design and manufacture of inductors to provide a novel and improved device configuration and manufacture processes to resolve the difficulties. It is desirable that the improved inductor configuration and manufacturing method can be simplified to achieve lower production costs, high production yield while capable of providing inductor that more compact with lower profile such that the inductor can be conveniently integrated into miniaturized electronic devices. It is further desirable the new and improved inductor and manufacture method can improve the production yield with simplified configuration and manufacturing processes.

SUMMARY OF THE PRESENT INVENTION

It is therefore an object of the present invention to provide a new structural configuration and manufacture method for manufacturing an inductor with simplified manufacturing processes to produce inductors with improved form factors having smaller height and size and more device reliability.

Specifically, this invention is a simplified method to manufacture an inductor by first forming the conductive coils and the leadframe by press punching a first and a second conductive plate into a first and a second coil layers and a first and second inductor lead layers respectively. The first and the second coil layers are connected and overlapped into an inductive circuit. The manufacturing processes are simplified as the coil layers and the inductor leads are formed as an integrated single layers and the inductor circuit is formed with only a welding process without requiring extra welding processes for attaching the coils to the lead frames. The production costs and time are significantly reduced, and the product reliability is greatly improved.

Briefly, in a preferred embodiment, the present invention includes an inductor includes a first coil layer and a first inductor lead layer pressed punched as a single layer with the first coil layer. The inductor further includes a second coil layer and a second lead layer pressed punched as a single layer the second coil layer wherein the first coil layer connected to and overlap with the second coil layer to form the inductor with the first inductor lead layer and the second inductor lead layer ready for connection to an input and output electric terminals. In a preferred embodiment, the first coil layer is welded to the second coil layer. In another preferred embodiment, the first and second coil layers composed of a metallic layer coated with an insulation layer.

This invention discloses a method for manufacturing an inductor by first pressed punching a first and a second layer of conductive plates into a first and second coil layers with a first and second inductor lead layers as single integrated layers. The manufacturing process further includes a step of overlapping and connecting the first and second coil layers to form an inductor. In a preferred embodiment, process of manufacturing further includes a step of mixing epoxy to bond with a highly magnetic material and pressure molding the bonding magnetic material around the coil layers to form an inductor.

These and other objects and advantages of the present invention will no doubt become obvious to those of ordinary skill in the art after having read the following detailed description of the preferred embodiment which is illustrated in the various drawing figures.

BRIEF DESCRIPTION OF THE DRAWINGS

FIGS. 1A to 1C are perspective views of an inductor of a prior art inductor formed according to a conventional manufacturing processes.

DETAILED DESCRIPTION OF THE PREFERRED EMBODIMENT

Figure 2A:
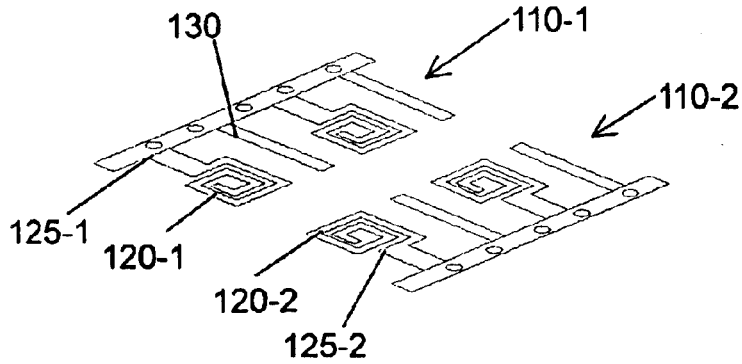
FIGS. 2A to 2E are a series of perspective views for showing the manufacturing processes to form the coil layers integrated with inductor lead layers and welding process to make the inductor of this invention.
Figure 2B:
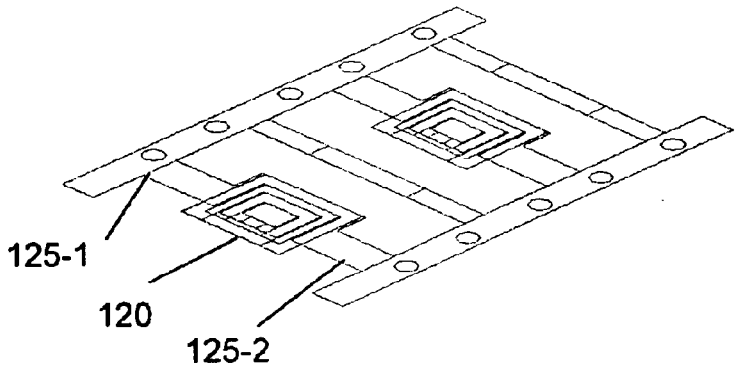
Figure 2C:
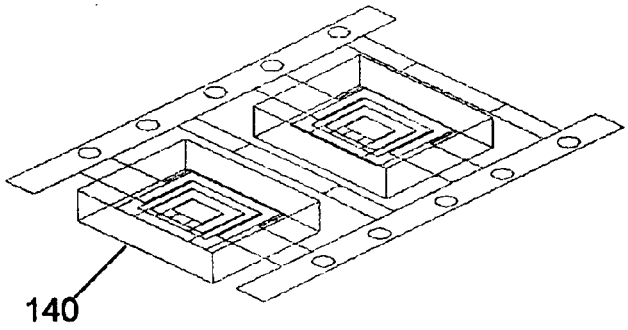

Referring to FIGS. 2A to 2E for a series of perspective views to illustrate the manufacturing processes of this invention. In FIG. 2A, a first and a second conductive plates 110-1 and 110-2 are press punched into a first coil layer 120-1 integrated with a first lead 125-1 and a second coil layer 120-2 integrated with a second lead 125-2 each having a conductive lead 130. A preferred conductive plate may be a copper plate for press punching into the first and second conductive layers 110-1 and 110-2. The copper layer may be enameled copper with a polymide enamel coating for insulation. More details of the conductive material for making the inductor coil layer 220-1 and 220-2 may be referred to U.S. Pat. No. 6,204,744. In FIG. 2B, the first and second coil layers 120-1 and 120-2 and also the leads 130 are overlapped and welded together thus the first coil layer 120-1 and the second coil layer 120-2 are connected as a inductor coil 120. The inductor coil 220 and the leads 125-1 and 125-2 are formed with a single welding operation thus greatly simplified the manufacturing process. The inductor 120 is flat and has a miniaturized height and size suitable for applications in modern electronic device that require miniaturized devices.

Figure 2D:
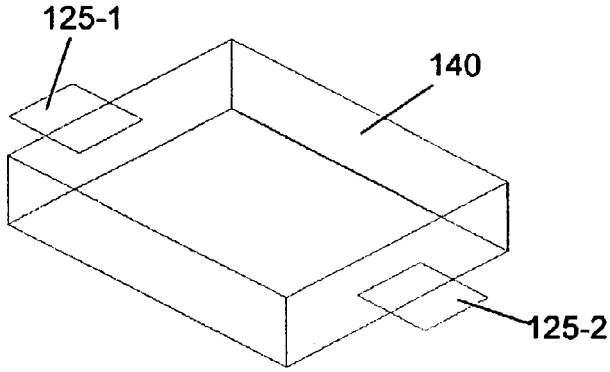
Figure 2E:
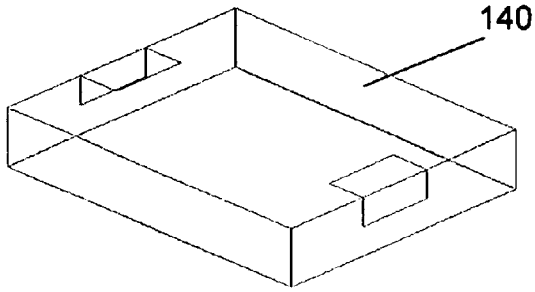
Figure 3A:
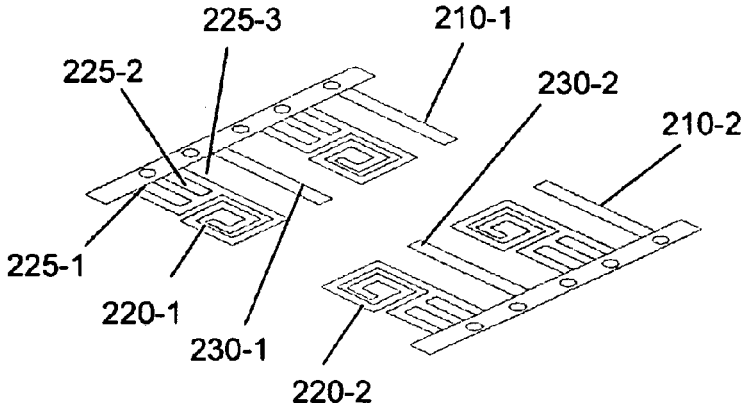
FIGS. 3A to 3E are a series of perspective views for showing the manufacturing processes to form the coil layers integrated with inductor lead layers and welding process to make another inductor of this invention.
Figure 3B:
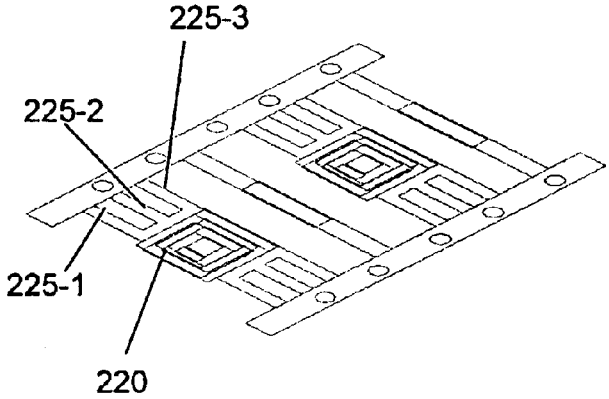
Figure 3C:
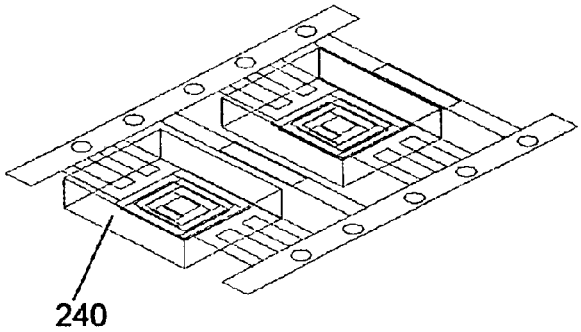
Figure 3D:
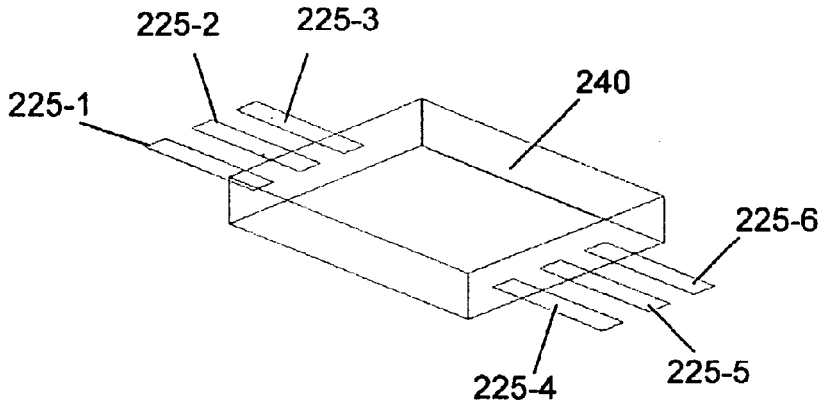
Figure 3E:
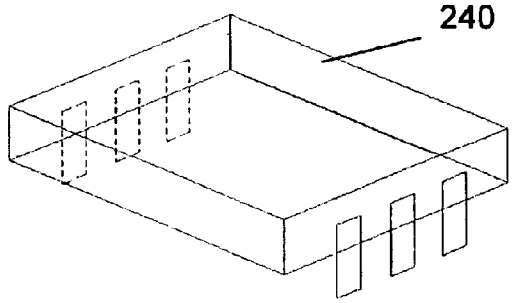
Figure 4A:
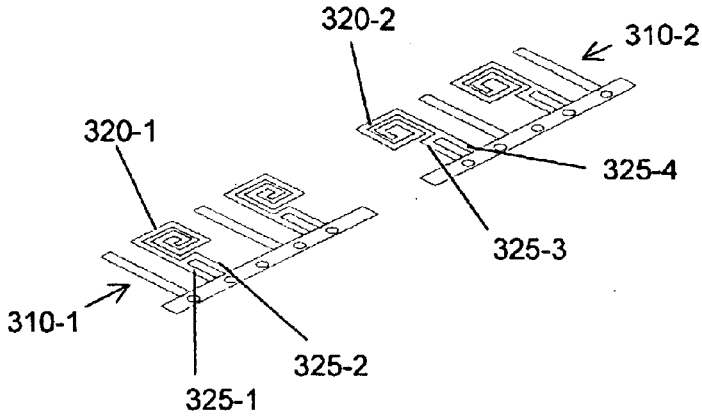
FIGS. 4A to 4E are a series of perspective views for showing the manufacturing processes to form the coil layers integrated with inductor lead layers and welding process to make another inductor of this invention.
Figure 4B:
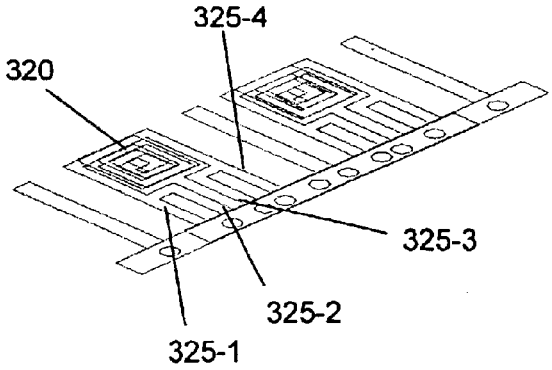
Figure 4C:
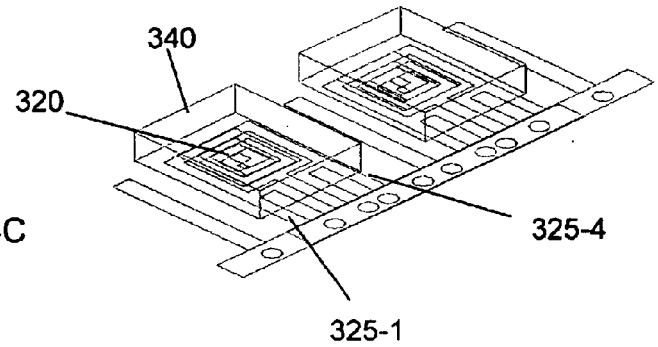
Figure 4D:
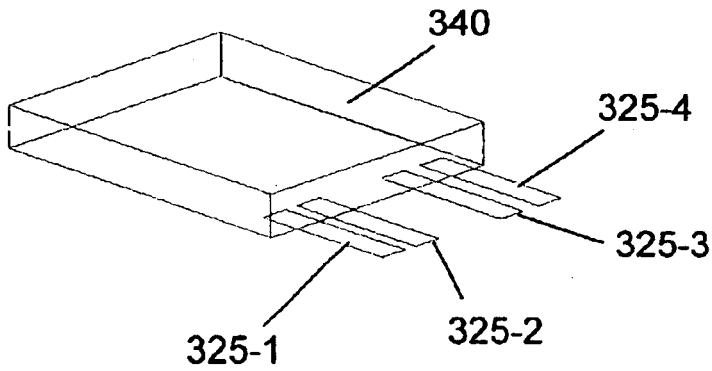
Figure 4E:
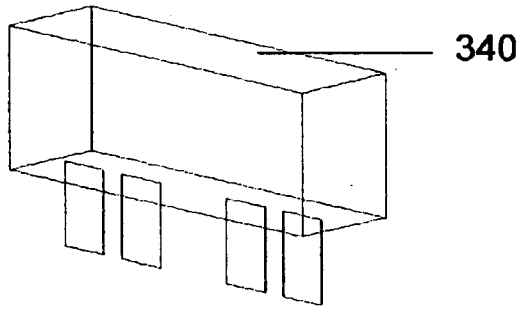

An inductor enclosure housing 140 is employed to contain the inductor 120 and to contain a powered magnetic molding material completely surrounding the inductor coil 120. The magnetic molding material is employed to increase the effectiveness of the inductor. Various magnetic molding materials may be employed. Details of different preferred magnetic molding materials and method for pressure molding and bonding to the enclosure housing 140 may be found in the U.S. Pat. No. 6,204,744, U.S. Pat. No. 6,204,744 is hereby incorporated by reference in this patent application. In FIG. 2D, the first and second lead frame layers 125-1 and 125-2 are cut as two electrodes and in FIG. 2E, two electrodes 125-1 and 125-2 are bent as two contact pads suitable for implementation in a circuit using a surface mount configuration.

FIGS. 3A to 3E are perspective views for showing another simplified manufacturing process for making inductors similar to that shown in FIGS. 2A to 2E. Instead of single inductor lead as that shown in FIGS. 2A to 2E, three lead layers 225-1 to 225-3 and 225-4 to 225-6 are formed for each end of the inductor 240 and these lead layers 225-1 to 225-6 are bent to form six pins suitable for inserting into pin holes or for pin-welding to suitable circuits that incorporate inductive function provided by the inductor 240.

FIGS. 4A to 4E are perspective views for showing another simplified manufacturing process for making inductors similar to that shown in FIGS. 2A to 2E. Instead of overlapping the coil layers 320-1 and 320-2 to arrange the lead layers 325-1 to 325-4 on opposite sides from each other, the process of overlapping the coil layers 320-1 and 320-2 are carried out to configure the lead layers 325-1, 325-2 connected to the first coil layer 320-1 and the lead layers 325-3, 325-2 connected to the second coil layer 320-2 on the same side of the inductor 320. After pressure molding and containing the inductor coil 320 in the enclosure housing 340, the lead layers 325-1 to 325-4 are formed as four pins suitable to form pin connections.

When compared to other inductive components the inductor of the present invention has several unique attributes. The conductive winding and the leads are formed with a single body structure thus having excellent connectivity and supreme reliability. The flat conductive winding has a very thin profile. Furthermore, the conductive winding the lead together with the magnetic core material, and protective enclosure are molded as a single integral low profile unitized body that has termination leads suitable for pin connection or surface mounting. The construction allows for maximum utilization of available space for magnetic performance and is self shielding magnetically.

The simplified manufacturing process of the present invention provides a low cost, high performance and highly reliable package. Simplified one-point welding process increase the production yields and reduces the production costs. The inductor is formed without the dependence on expensive, tight tolerance core materials and special winding techniques. A flat conductive coil functioning as conductive winding of this invention allows for high current operation and optimizes the magnetic parameters by using magnetic molding material for surrounding and bonding the conductive windings. By applying suitable magnetic bonding materials as the core material, it has high resistivity that exceeds three mega ohms that enables the inductor to carry out the inductive functions without a conductive path between the leads that can be connected to various circuits either by surface mounting or pin connections. It is flexible to use different magnetic material to allow the inductor for applications in circuits operable at different level of frequencies. The inductor package performance according to this invention yields a low DC resistance to inductance ratio, e.g., 2 milli-Ohms per micro-Henry, that is well below a desirable ratio of 5 for those of ordinary skill in the art for inductor circuit designs and applications.

According to FIGS. 1 to 4 and above descriptions, this invention discloses an inductor that includes a first coil layer and a first inductor lead layer pressed punched as a single layer with the first coil layer. The inductor further includes a second coil layer and a second lead layer pressed punched as a single layer with the second coil layer wherein the first coil layer connected to and overlap with the second coil layer to form the inductor with the first inductor lead layer and the second inductor lead layer provided for connection to an input and output electric terminals. The first coil layer is welded to the second coil layer. Each of the first and second coil layers further includes a metallic layer, e.g., a copper layer, coated with an insulation layer, e.g., a polymide enamel coating layer. The inductor further includes a powered magnetic molding surrounding the first and second coil layers. The inductor further includes an inductor enclosure housing for containing the powdered magnetic molding surrounding the first and second coil layers therein. Each of the first and second inductor lead layers extended from the inductor constituting an input and an output electrical terminals for the inductor having a terminal shape suitable for surface mounting or pin insertion of the inductor.

This invention further discloses a method for manufacturing an inductor. The method includes a step of pressed punching a first and a second layer of conductive plates into a first and second coil layers with a first and second inductor lead layers as single integrated layers. And, another step of overlapping and connecting the first and second coil layers to form an inductor. The method further includes a step of mixing an epoxy to bond with a highly magnetic material and pressure molding the magnetic material around the first and second coil layers.

In essence, this invention discloses an inductor that includes at least two overlapped and interconnected coil layers having at least two of the coil layers pressed punched as a single layer with an input lead layer and an output layer respectively provided for connecting to an input and output of the inductor.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An inductor comprising:

a first coil layer and a first inductor lead layer pressed punched as a single layer with the first coil layer;

a second coil layer and a second lead layer pressed punched as a single layer with the second coil layer wherein said first coil layer connected to and overlap with the second coil layer to form the inductor with said first inductor lead layer and said second inductor lead layer provided for connection to an input and output electric terminals.

2. The inductor of claim 1 wherein:

said first coil layer is welded to said second coil layer.

3. The inductor of claim 1 wherein:

each of said first and second coil layers further comprising a metallic layer coated with an insulation layer.

4. The inductor of claim 1 wherein:

each of said first and second coil layers further comprising a copper layer coated with an insulation layer.

5. The inductor of claim 1 wherein:

each of said first and second coil layers further comprising a conductive layer coated with a polymide enamel coating layer.

6. The inductor of claim 1 further comprising:

a powered magnetic molding surrounding said first and second coil layers.

7. The inductor of claim 1 wherein:

each of said first and second coil layers further comprising a conductive layer coated with an insulation layer; and said inductor further comprising a powered magnetic molding surrounding said first and second coil layers.

8. The inductor of claim 1 further comprising:

an inductor enclosure housing containing said first coil layer and said second coil layer therein.

9. The inductor of claim 1 wherein:

each of said first and second coil layers further comprising a conductive layer coated with an insulation layer;

said inductor further comprising a powered magnetic molding surrounding said first and second coil layers; and said inductor further comprising an inductor enclosure housing for containing said powdered magnetic molding surrounding said first and second coil layers therein.

10. The inductor of claim 1 wherein:

each of said first and second inductor lead layers extended from said inductor constituting an input and an output electrical terminals for said inductor.

11. The inductor of claim 1 wherein:

each of said first and second inductor lead layers extended from said inductor constituting an input and an output electrical terminals having a terminal shape suitable for surface mounting said inductor.

12. The inductor of claim 1 wherein:

each of said first and second inductor lead layers extended from said inductor constituting an input and an output electrical terminals having a terminal shape suitable for pin-insertion of said inductor.

13. An inductor comprising:

a first coil layer and a first inductor lead layer pressed punched as a single layer with the first coil layer;

a second coil layer and a second lead layer pressed punched as a single layer with the second coil layer wherein said first coil layer is welded to and vertically overlap with said second coil layer to form said inductor with said first inductor lead layer and said second inductor lead layer provided for connection to an input and output electric terminals;

each of said first and second coil layers further comprising a conductive layer coated with an insulation layer;

a powered magnetic molding surrounding said first and second coil layers; and an inductor enclosure housing for containing said powdered magnetic molding surrounding said first and second coil layers therein.

14. The inductor of claim 13 wherein:

each of said first and second inductor lead layers extended from said inductor constituting an input and an output electrical terminals outside of said inductor enclosure housing having a terminal shape suitable for surface mounting said inductor.

15. The inductor of claim 13 wherein:

each of said first and second inductor lead layers extended from said inductor constituting an input and an output electrical terminals outside of said inductor enclosure housing having a terminal shape suitable for pin-insertion of said inductor.

16. A method for manufacturing an inductor comprising:

pressed punching a first and a second layer of conductive plates into a first and second coil layers with a first and second inductor lead layers as single integrated layers; and overlapping and connecting said first and second coil layers to form an inductor.

17. The method of claim 16 further comprising:

mixing an epoxy to bond with a highly magnetic material and pressure molding said magnetic material around said first and second coil layers.

18. An inductor comprising:

at least two overlapped and interconnected coil layers having at least two of said coil layers pressed punched as a single layer with an input lead layer and an output lead layer respectively provided for connecting to an input and output of said inductor.

19. The inductor of claim 18 further comprising:

a powered magnetic molding surrounding said interconnected coil layers.

20. The inductor of claim 18 wherein:

each of said input lead layer and said output lead layer extending from said inductor having a terminal shape for implementing a conveniently external connection.

* * * * *